US005171172A

United States Patent [19]

Heaton et al.

[11] Patent Number: 5,171,172

[45] Date of Patent: Dec. 15, 1992

[54] AUTOMATIC ENGINE TRIM SYSTEM

[75] Inventors: Robert J. Heaton; John A. Michael, both of Sarasota, Fla.

[73] Assignee: Teleflex Incorporated, Limerick, Pa.

[21] Appl. No.: 698,377

[22] Filed: May 19, 1991

Related U.S. Application Data

[63] Continuation of Ser. No. 381,207, Jul. 18, 1989, abandoned.

[51] Int. Cl.[5] ..... B63H 5/12

[52] U.S. Cl. ..... 440/1

[58] Field of Search ..... 440/1, 53, 61

[56] References Cited

U.S. PATENT DOCUMENTS

| | | | |
|---|---|---|---|
| 4,318,699 | 3/1982 | Wenstadt et al. | 440/1 |
| 4,413,215 | 11/1983 | Cavil et al. | 114/144 E |
| 4,565,528 | 1/1986 | Nakase | 440/1 |
| 4,778,414 | 10/1988 | Taguchi | 440/1 |
| 4,813,896 | 3/1989 | Koike et al. | 440/61 |
| 4,824,407 | 4/1989 | Torigai et al. | 440/61 |
| 4,872,857 | 10/1989 | Newman et al. | 440/1 |
| 4,898,563 | 2/1990 | Torigai et al. | 440/1 |

*Primary Examiner*—Sherman Basinger
*Assistant Examiner*—Thomas J. Brahan
*Attorney, Agent, or Firm*—Reising, Ethington, Barnard, Perry & Milton

[57] ABSTRACT

An automatic trim assembly (10) adjusts the trim of an engine (14) in a boat (12) based upon the speed of the boat (12). A pressure switch (18) senses the speed of the boat from a pitot tube and switches to a first condition when the speed is below a predetermined speed and to a second condition when the speed is above the predetermined speed. A control circuit (16) trims the engine (14) to a first or low position in response to the switch (18) being in the first condition, and trims the engine (14) to a second or high position in response to the switch (18) being in the second condition. An initiation circuit (62) is provided to automatically trim the engine (14) to the first position upon start-up of the assembly (10). An inhibit circuit (64) prevents trimming of the engine (14) to the first position when the speed of the boat exceeds the predetermined speed upon start-up of the assembly (10).

36 Claims, 6 Drawing Sheets

+V
C14
C13
D12
R39
D11
12V
104
44
L
D10
D9
Q2
62
R38
96
D8
R37
94
D5
R36
100
F
T1
T2
T3
T4
0/B
1/0
102
50
R33
98
H
R14
C5
48
R35
92
34
+Vcc
L
32
R34
42
G
120
B
122
8
132
10
9
+V
R17
R18
E
H
D7
D6
Q1
59
58
24

AUTOMATIC ENGINE TRIM SYSTEM

This application is a continuation of application Ser. No. 381,207, filed Jul. 18, 1989, now abandoned.

TECHNICAL FIELD

The invention relates to the trim control of an engine on a boat, and more particularly, to the automatic control thereof based upon the speed of the boat.

BACKGROUND OF THE INVENTION

In general, a boat is provided with an engine which is designed about an axis to bring the engine inwardly or push it outwardly from the boat to change the trim or, thrust angle of the propeller force between an upwardly inclined angle and a downwardly inclined angle. When the operator adjusts the throttle for greater speed, he must then retrim the outboard or inboard/outboard engine for optimum performance. When the throttle is readjusted for low speed, the trim must be readjusted. The operator must depress the tilt switch and visually monitor engine position.

Recently, it has been desirable to provide an automatic trim adjustment assembly which automatically adjusts the trim of the engine or drive unit, depending upon the speed of the boat. One such assembly is disclosed in U.S. Pat. No. 4,718,872, issued Jan. 12, 1988 in the name of Olson et al which discloses an automatic trim system that automatically senses for increase and decrease in speed. The system will step the trim motor and determine whether the speed of the boat has increased. If the speed of the boat decreases due to the new position of the engine, the trim motor will return the engine to the previous position where the boat has maximized its speed. Other types of systems disclose trimming a boat based on the angular position of the boat with respect to the water and the tilting thereof, which is disclosed in U.S. Pat. No. 4,401,888 in name of West et al and U.S. Pat. No. 4,524,710 in the name of Scott.

The problem with these types of assemblies is that continuous change of the trim is not necessary, and manual change in the trim at predetermined speeds may be desired with return to predetermined positions at predetermined speeds.

SUMMARY OF THE INVENTION AND ADVANTAGES

The invention is an automatic trim assembly for adjusting the trim of an engine in boat. The assembly comprises control means for trimming the engine to a first position in response to a first condition and for trimming the engine to a second position in response to a second condition. The assembly is characterized by including switch means connected to the control means for sensing a speed of the boat and for automatically switching between said first condition when the speed is less than a first predetermined speed and for second condition when the speed exceeds a second predetermined speed.

Also included is a method for automatically trimming an engine in a boat. The method includes steps of sensing the speed of the boat, switching between a first condition when the speed is less than a first predetermined speed and a second condition when the speed exceeds a second predetermined speed, trimming the engine to a first position in response to the first condition, and trimming the engine to a second position in response to the second condition.

The advantages of such an assembly and method include the trim being automatically adjusted as the function of speed, and furthermore, the first and second positions of the trimming are adjustable by the operator.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
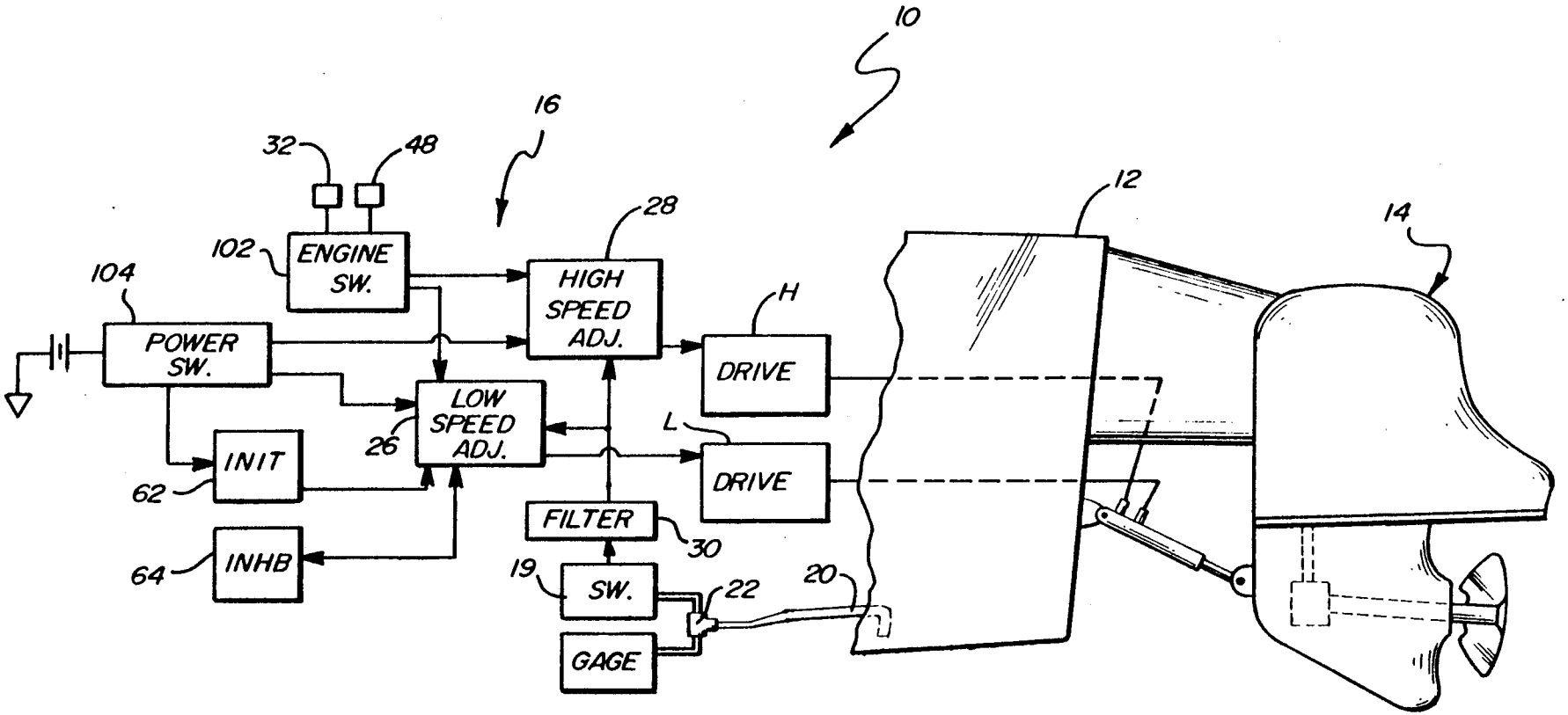
FIG. 1 a perspective view of the subject invention in a boat of a first embodiment.

An automatic trim assembly for adjusting the trim of an engine in a boat 12 is generally shown at 10 in FIGS. 1. In general, the drive unit or engine 14 may pivot about an axis to bring the drive unit inwardly or push it outwardly from the boat 12 to change the thrust angle of the propeller force between the upwardly inclined angle and downwardly inclined angle. It is generally desirable to trim the engine 14 outwardly from the boat 12 at high speeds and trim the engine 14 inwardly into the water at low speeds.

The assembly 10 includes control means 16 for trimming the engine 14 to a first position in response to a first condition and for trimming the engine 14 to a second position in response to a second condition. Included is speed switch means 18 connected to the control means 16 for sensing the speed of the boat 12 and for switching between the first condition when the speed is less than a first predetermined speed and to the second condition when the speed exceeds a second predetermined speed. In other words, the engine 14 is capable of pivoting about the axis between a variable first position and a second position. The speed switch means 18 determines whether the control means 16 will trim the engine to the first position or second position based on the speed.

The speed switch means 18 comprises a pressure switch 19 connected to the pitot tube 20 of the engine 14, and which is normally closed to the first condition. The pressure switch 19 is a 4.8–5 psi switch (available from B.M.I. of England) which switches at approximately 22 mph. As commonly known in the art, a boat 12 includes a pitot tube 20 for sensing the speed of the boat by a connection to the speed gage. The pressure switch 21 produces a speed signal indicative of the position of the switch 21. In the preferred embodiment, the pitot tube 20 is inserted by a T-connector 22 such that the gage may be connected to a first output port and the pressure switch 21 may be connected to a second output port of the T-connector 22.

Figure 2A:
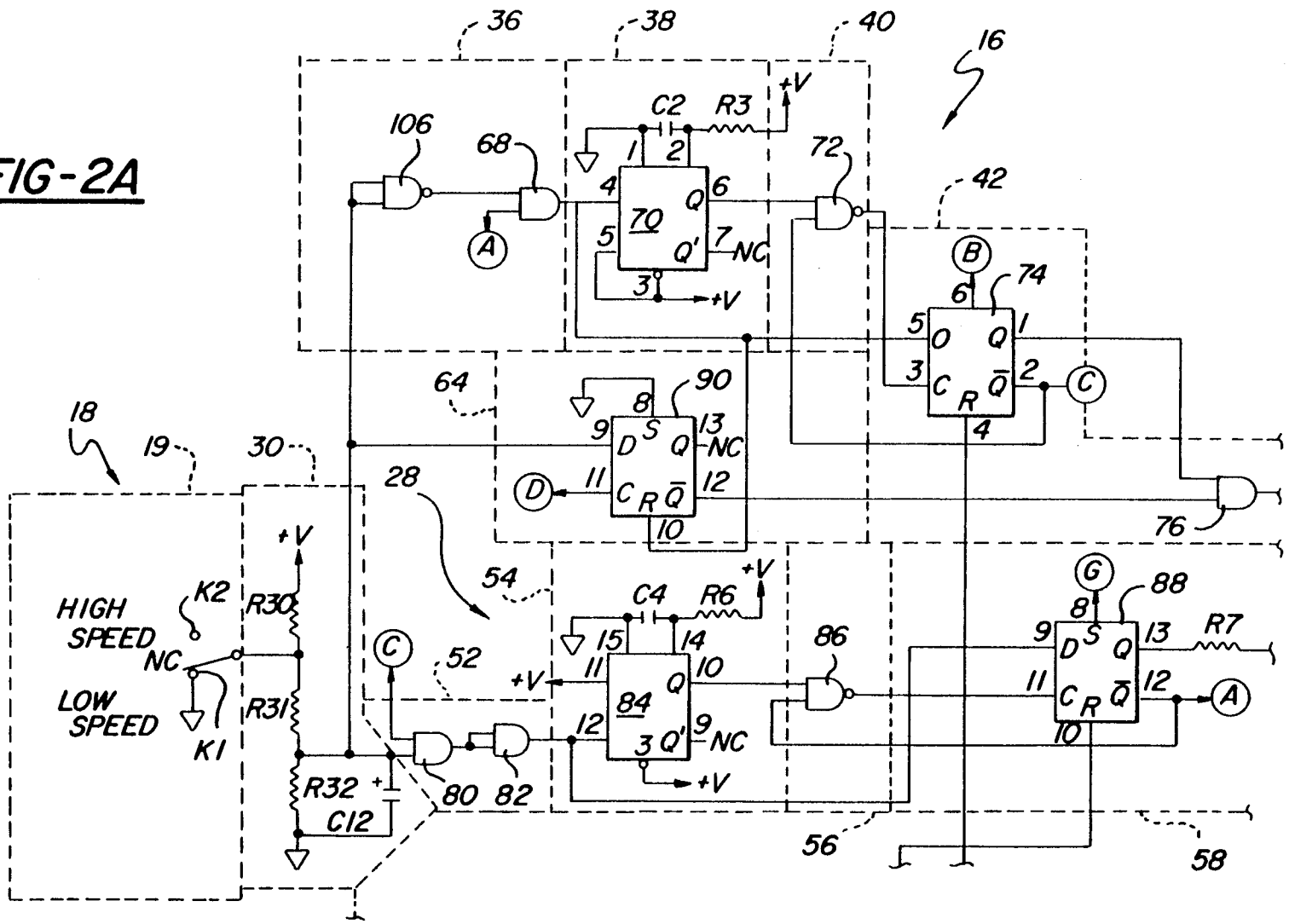
FIG. 2 is a schematic diagram of the subject invention of the first embodiment.
Figure 2B:
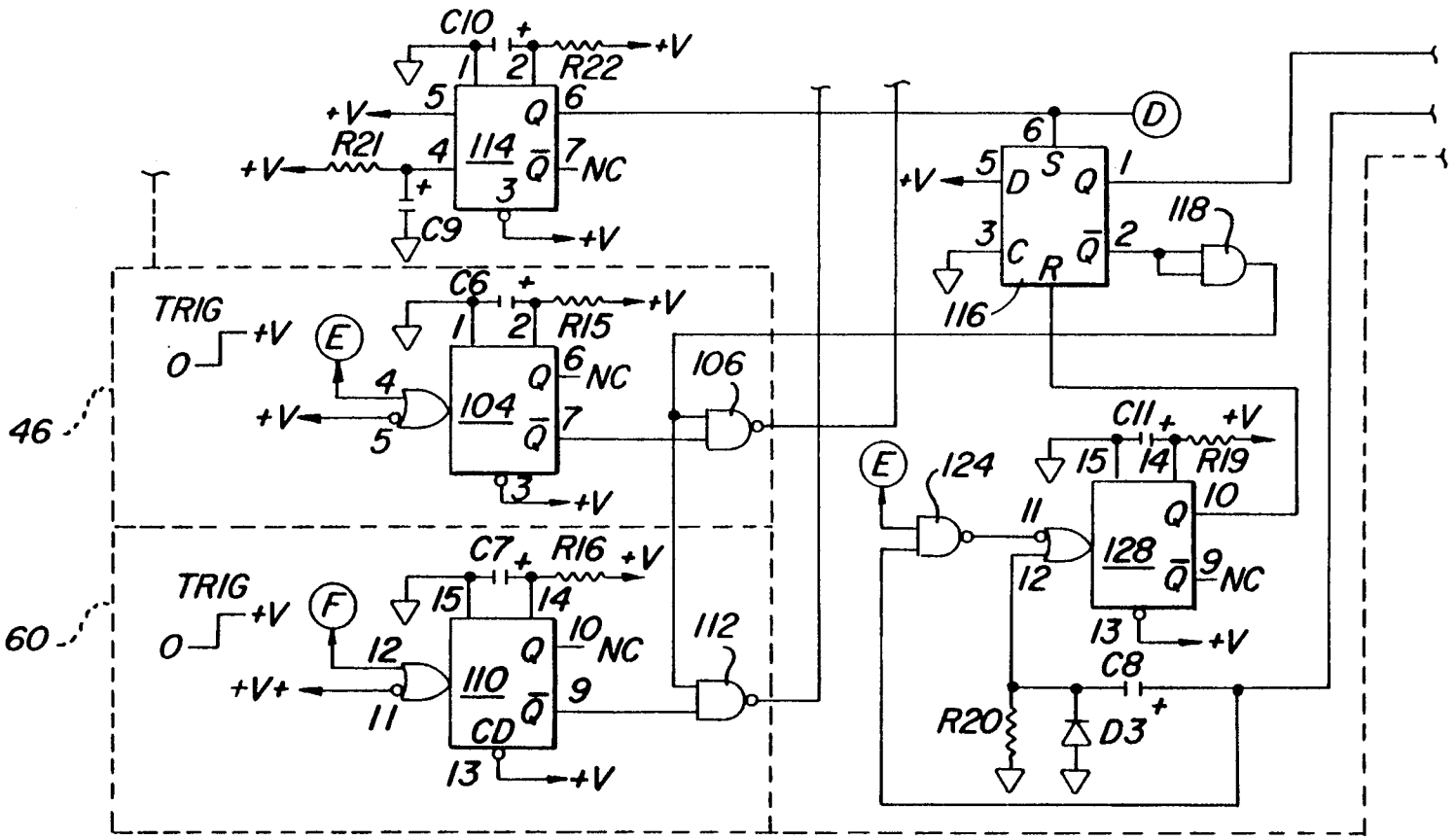
Figure 2C:
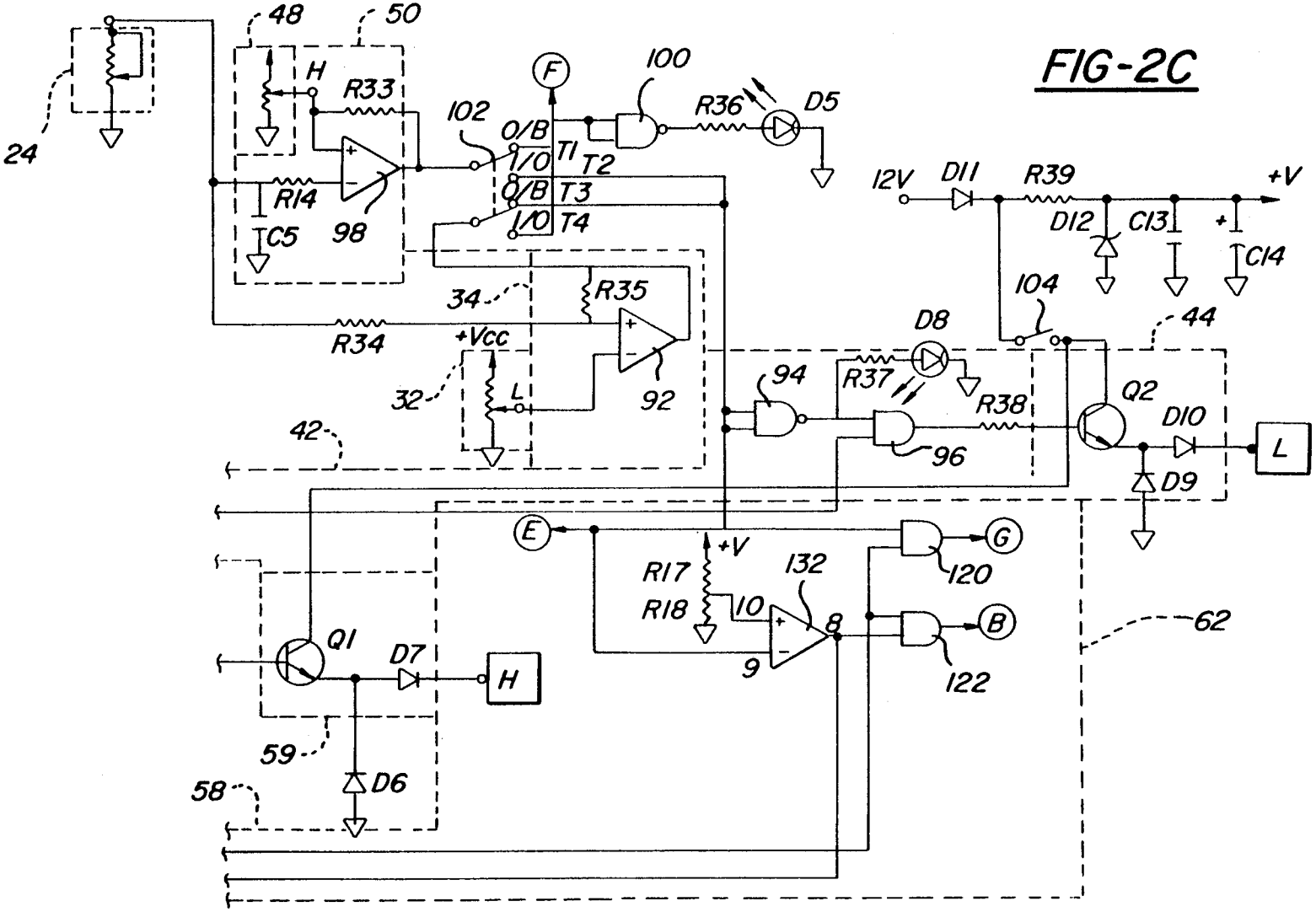
Figure 3:
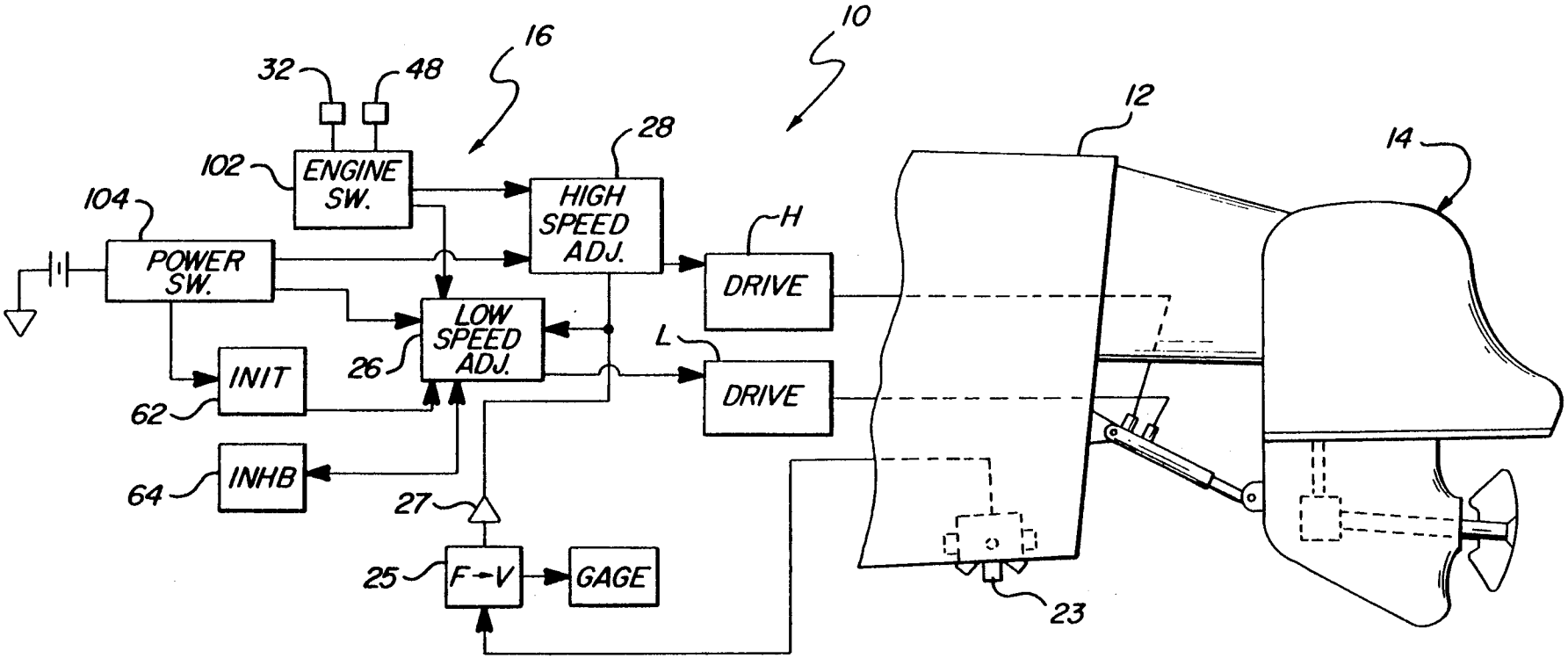
FIG. 3 is a perspective view of a second embodiment of the subject invention.
Figure 4:
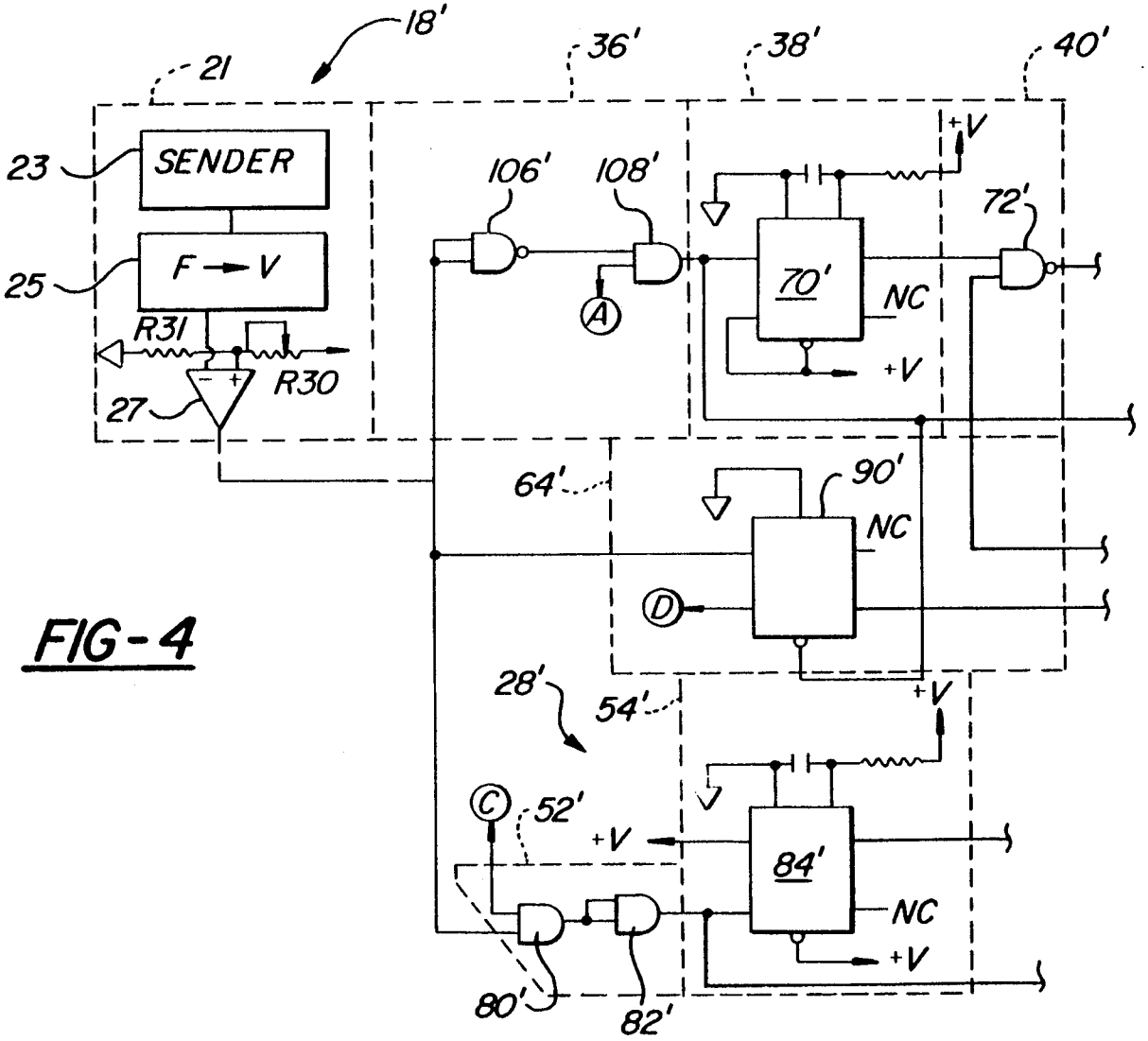
FIG. 4 is the partial schematic diagram of the second embodiment.

Alternatively, as illustrated in FIGS. 3 and 4 the speed switch means 18 may comprise a wheel switch 21 for sensing the speed of the boat 12 and switching between the first and second conditions. In this embodiment, a paddle wheel sender 23 is connected external the boat 12 in contact with the water to provide a square wave signal whose frequency is directly proportional to speed. A frequency to voltage converter 25 (LM 2807) receives the square wave signal and produces an output signal which is a rising linear ramp voltage directly proportional to boat speed, or the paddle wheel revolutions per minute. The output signal is received by the gage of the boat and by a comparator switch 27 which compares the output voltage to the predetermined speed, which produces the speed signal. Primed reference numerals in FIGS. 3 and 4 represent similar components of unprimed reference numerals in FIGS. 1 and 2. Only one of either the pressure switch 19 or the wheel switch 21 need be used to provide the speed signal.

The speed switch means 18 has two positions wherein the normally closed position comprises the first condition. When the speed exceeds the second predetermined speed (approximately 22 mph), the speed switch 18 is moved to the second condition. As subsequently described, the first condition represents a low speed position and the second condition represents a high speed position. In the preferred embodiment, the first and second predetermined speeds are equal such that the speed switch 18 remains in the normally closed position until the speed increases to the predetermined speed (approximately 22 mph) to switch to the second position, and returns to the normally closed position when the speed decreases below the predetermined speed.

The assembly 10 includes an engine switch 102 which allows the installer to select between inboard/outboard (I/O) engines and outboard (O/B) engines. The major differences between the types of engines is that the trim position means on the engine has opposite polarity between the two types. Additionally, the system includes a power switch 104. The power switch 104 is closed during the automatic trimming of the assembly 10, and is left open during the manual trimming by the operator or setting of the first and second positions. The assembly 10 will be generally described with the engine switch 102 in the O/B position, and differences in function of the assembly 10 with the switch 102 in the I/O position described subsequently.

The assembly 10 also includes trim position means 24 for producing an actual position signal indicative of the absolute trim position of the engine 14. The trim position means 24 comprises a trim position sender, as commonly known in the art, which produces the actual position signal indicating the absolute position of the engine 14.

The control means 16 includes first position means 32 for manually setting the first position of the trim. The first position means 32 allows the operator to adjust the position or height of the engine at low speeds below the predetermined speed. The first position means 32 generally comprises a potentiometer which is adjusted by the operator, which produces a first position signal. The first position means 32 includes a knob (not shown) to allow the operator to adjust the first position potentiometer 32.

The control means 16 includes first position comparator means 34 which receives and compares the actual position signal and the first position signal to produce a low speed actuate signal. The first position comparator means 34 produces the low speed actuate signal when the actual trim position is not equal to the ideal position set by the first position potentiometer 32.

The control means 16 includes second position means 48 for manually setting the second position of the trim of the engine. The second position means 48 generally comprises a potentiometer which is adjusted by the operator, which produces a second position signal. The second position means 48 includes a knob (not shown) to allow the operator to adjust the second position potentiometer 48.

Also includes is second position comparator means 50 which receives and compares the actual position signal to the second position signal to produce and high speed actuate signal. The second position comparator means 34 produces the high speed actuate signal when the actual trim position is not equal to the ideal position as set by the second position potentiometer 48.

The control means 16 includes low speed adjustment means 26 responsive to the speed switch 18 and the actual position signal for trimming the engine 14 to the first position in response to the first condition. In other words, as long as the speed switch 18 remains in the normally closed or first condition, the low speed adjustment means 26 will ensure that the engine 14 is trimmed to the first position, which is generally a lower position.

The control means 16 also includes high speed adjustment means 28 responsive to the speed switch 18 and the actual position signal for trimming the engine 14 to the second position in response to the second condition. When the sensed speed exceeds the predetermined speed, the speed switch 18 will switch to the second condition wherein the high speed adjustment means 28 will trim the engine 14 to the second position, or higher position.

The control means 16 includes filter means 30 connected to the speed switch 18 for filtering out high frequency components and noise, eliminating switch bounce and chatter, from the speed signal of the pressure switch 19. The filter means 30 produces a filtered speed signal.

The low speed adjustment means 26 includes low speed enabling means 36 for receiving the filtered speed signal from the filter means 30 for producing a low speed enabling signal when the speed switch 18 is in the first condition and receiving a high speed off signal indicating the high speed drive means 58 is off as subsequently explained. The low speed enabling means 36 is enabled by the high speed off signal to ensure the engine is not trimmed in both directions at the same time. Low speed delay means 38 receives the enabling signal and produces a momentary or one-shot delay signal after a predetermined time of continuously receiving the enabling signal. The predetermined time delay is generally 3–10 seconds. The time delay is provided for the case when the boat or pitot tube is out of the water, whether on sharp turn or in condition of waves, to prevent changes in the trim when unnecessary.

The low speed adjustment means 26 includes low speed lock-out means 40 for receiving the delay signal and a low speed off signal indicating the low speed drive means 42 is off to produce a gate signal in the presence of only one of the enabling signal and the low speed off signal. If both the enabling signal and the low speed off signal are present or both are absent, the gate signal will not be produced. The low speed drive means 42 receives the gate signal and produces a drive signal to trim the engine toward the first position, and produces the low speed off signal in the absence of the gate signal and after receiving a low speed reset signal to reset. The low speed drive means 42 includes a low drive switch 44 which is connected to the trim drive unit L of the engine 14 for continuously powering the trim drive unit L in a direction to move the engine 14 toward the first position in response to the production of the drive signal. When the engine 14 is in the first position, the first position comparator means 34 will discontinue producing a low speed actuate signal which in turn will discontinue the drive signal and trimming of the engine.

Low speed reset means 46 receives low speed actuate signal and produces an low speed reset signal to the low speed drive means 42 when the low speed comparator means 34 discontinues the actuate signal. In the transition of an absence of the low speed actuate signal, the low speed reset means 46 will send a reset signal to the low speed drive means 42.

The high speed adjustment means 28 is similar in components and operation to the low speed adjustment means 26, as will be described hereinafter with differences identified. The high speed adjustment means 28 includes second position enabling means 52 which receives the filtered speed signal from the filter means 30 for producing an high speed enabling signal when the pressure switch 18 is in the second condition and is receiving the low speed off signal. High speed delay means 54 receives the enabling signal and produces a one-shot delay signal after a predetermined time of continuously receiving the enabling signal. The time delay is provided for the reasons of the low speed delay means 38.

High speed lock-out means 56 receives the delayed signal and high speed off signal indicating the high speed drive means 58 is off to produce a gate signal in the presence of only one of the enabling signal and the high speed off signal. The high speed drive means 58 receives the gate signal and produces a drive signal to trim the engine toward the second position, and produces the high speed off signal in the absence of the gate signal and after receiving a reset signal to reset. The high speed drive means 58 includes a high speed switch 59 which is connected to the trim drive unit H of the engine 14 for continuously powering the trim drive unit in a direction to move the engine 14 toward the second position. When the engine 14 is in the second position, the second position comparator means 50 will discontinue producing the actuate signal which in turn will discontinue the drive signal and trimming of the engine. High speed reset means 60 receives the high speed actuate signal and produces the high speed reset signal for the high speed driver means 58.

The control means 16 includes initiating means 62 for trimming the engine to the first position upon start-up of the assembly 10 or closing of the power switch 104 as long as the speed has not exceeded the predetermined speed. If the automatic trim assembly 10 is turned on before the ignition switch of the boat 12 is turned on, then the engine 14 will be automatically be trimmed to the low speed position, regardless of where the engine was previously trimmed. When the engine 14 is trimmed to the first position, the initiation means 62 will be disabled until the next power-up sequence. Inhibit means 64 prevents the initiating means 62 from trimming the engine 14 to the low position if the auto trim is selected while the boat 12 is being operated at high speed in excess of the predetermined speed.

The assembly 10 is used in both outboard (O/B) and inboard/outboard (I/O) engines. The specific schematic diagram of the assembly 10 is illustrated in FIG. 2. FIG. 4 represents a portion of the schematic of FIG. 2 illustrating the schematic of for the paddle wheel 23; the remainder of the schematic not shown in FIG. 4 is the same as FIG. 2. The engine switch 102 includes two input contacts A, B, one B from the first position comparator means 34 and the second A from the second comparator means 50. The second input contact A is connected to a switch arm which switches between first T1 and second T2 output terminals. The first terminal T1 for O/B produces a high speed actuate signal and the second terminal T2 for I/O produces a low speed actuate signal. The first input contact B is connected to a switch arm which switches between third T3 and fourth T4 output terminals. The third terminal T3 for O/B produces a low speed actuate signal and the fourth terminal T4 for I/O produces a high speed actuate signal. Therefore, it is understood that the first position means 32 and comparator means 34 provides low speed reference in the O/B position at terminal T3 and provides high speed reference in the I/O position at terminal T4. Likewise, the second position means 48 and comparator means 50 provides high speed reference in the O/B position at terminal T1 and provides low speed reference in the I/O position at terminal T2. In other words, when the engine switch 102 is in the O/B position, the first position comparator means 34 produces the low speed actuate signal and the second position comparator means 50 produces the high speed actuate signal. The roles of the comparator means 34 and 50 are reversed when the engine switch 102 is in the I/O position. This is because the polarity of the trim sender 24 on the engine 14 has opposite polarity between the I/O and O/B engines. The remainder of the assembly 10 operates the same for both O/B and I/O.

The pressure switch 19 in the first embodiment of the speed switch 18 switches between two contacts K1, K2. The first contact K1 establishes the first condition in the normally closed position, and the second contact K2 establishes the second condition. The pressure switch 19 switches between the first position at the first contact K1 which is normally closed and connected to ground, and the second position at the second contact K2 which is an open connection. The output of the pressure switch 19 is connected to the filter means 30 comprising resistor R1 (2 K Ohm) connected to power and to the pressure switch 18, resistor R31 (150 Ohms) connected between resistor R30 and a resistor R32 (10 K Ohm) connected to ground, having a capacitor C12 (33 uF) connected across resistor R32 producing the filtered speed signal.

The comparator switch 27 of the second embodiment of the speed switch 18 comprises an operational amplifier configured as a comparator which receives the output signal at its inverting input and receives the predetermined speed at its non-inverting input. The predetermined speed is established by a voltage divider comprising a potentiometer R30 and resistor R31. The speed signal produced by the comparator 27 is sent directly to the NAND gate 106 and AND gate 80 and D flip flop 90, as subsequently explained.

The low speed enabling means 36 comprises a NAND (inverter) gate 106 receiving as its two inputs the filtered speed signal and an AND gate 68 having a first input connected to the output of NAND gate 106 and a second input connected to the Q' output (high speed off signal) of the high speed drive means 58. The output of the AND gate 68 is connected to the low speed time delay means 38 comprising a one-shot, monostable multivibrator 70 (MC14538B) having pin 4 connected to the output of the AND gate 68, pins 3 and 5 connected to voltage +V, pin 1 connected to ground and pin 2 connected through capacitor C2 (1 uF) to pin 1, and pin 2 connected through resistor R3 (3.3 M Ohms) to voltage +V. The Q output is at pin 6 and connected to the low speed lock-out means 40 comprising a NAND gate 72 receiving the Q output of the monostable multivibrator 70 and receiving as a second input the low speed off signal. The output of the NAND gate 72 is connected to the low speed drive means 42 comprising a D flip flop 74 (MC14013B) having pin 3 or the clock input connected to the output of the NAND gate 72. Pin 5 or the D input is connected to the output of the AND gate 68, pin 4 or the reset input receives the low speed reset signal and Q' output or pin 2 produces the low speed off signal and is connected to and the input of the NAND gate 72, and the Q output is connected to the input of safety AND gate 76. The filtered speed signal is also connected to the high speed enabling means 52 comprising a first AND gate 80 receiving the filtered speed signal and the low speed off signal. The output of the AND gate 80 is connected to the two inputs of a second AND gate 82. The output of the second AND gate 82 is connected to the input pin 12 of one-shot monostable multivibrator 84 (MC-14538BCP) comprising the high speed time delay means 54. The monostable multivibrator 84 has pins 3 and 11 connected to power +V, pin 15 connected to ground and pin 14 connected through capacitor C4 (1 uF) to pin 15 and through resistor R6 (3.3 M Ohms) to power +V. Output pin 10 is the Q output and is connected to the high speed lock-out means 56 comprising a NAND gate 86 for receiving the Q output and the high speed off signal. The output of the NAND gate 86 is received by the high speed drive means 58 comprising a D flip flop 88 receiving the output of the NAND gate 86 at its clock or pin input. Pin 9 of D-input is connected to the output of the enabling means 52 or AND gate 82, pin 12 produces the high speed off signal or Q' signal to the input of the AND gate 68, and pin 13 or the Q output is connected through resistor R7 (20 K Ohms) to the base of drive transistor Q1 comprising drive switch 59. Transistor Q1 has its collector connected to the power switch 104 and its emitter produces the up-drive high speed output through diode D7 and having diode D6 connected between the emitter and ground to the drive unit H.

The inhibit means 64 includes D-flip flop 90 having its D input or pin 9 receiving the filtered speed signal and having the clock input or pin 11 connected to pin 6 of monostable 114 of the initiating means 62, as subsequently explained. The set input or pin 8 is connected to ground, the reset input or pin 10 is connected to the output of AND gate 68, and Q' output or pin 12 is connected to the second input of the safety AND gate 76. The safety AND gate 76 receives the Q output from the low speed D-flip flop 74 and the Q, output from the inhibit D-flip flop 90. The trim or actual position means 24 includes a resistive element for producing the actual speed signal.

The second position is established by the second position potentiometer 48 producing the second position signal and connected to the noninverting input of operational amplifier 98 comprising the second position comparator means 50. The inverting input of operational amplifier 98 receives the actual position signal through a filter comprising capacitor C5 (0.1 uF) and R14 (10K ohm), a feedback resistor R33 (220 K Ohm) is connected as feedback to the noninverting input. The output of the operational amplifier 98 is connected to the second arm A of the engine switch 102 having a high position of O/B at terminal T1 and a lower position of I/O at terminal T2. The first position potentiometer 32 is received by a operational amplifier 92 at its inverting input comprising the first position comparator means 34. The actual position signal is received through resistor R34 (1 K Ohm) at the noninverting input of operational amplifier 92 with resistor R35 (220 K Ohm) connected as feedback to the noninverting input. The output of operational amplifier 92 is connected to a second arm B of switch 102 having a high position of O/B at terminal T3 and a low position of I/O at terminal T4. The two arms of the engine switch 102 move together between either their high positions of O/B or the low positions of I/O. The first T1 and fourth T4 terminals of engine switch 102 producing the high speed actuate signal are connected to pin 12 of monostable 110 and to the two inputs of NAND gate 100, whose output feeds both inputs of NAND gate 100, and the output connected to resistor R36 (2 K Ohm) to LED D5 connected to ground. The second T2 and third T3 terminals producing the low speed actuate signal are connected to both inputs of NAND gate 94 whose output is connected through resistor R37 (2 K Ohm) to an LED D8 to ground. The output of NAND gate 94 is also connected to AND gate 96 having its second input connected to the output of safety AND gate 76, the output of AND 96 connected through resistor R38 (20 K Ohm) to the base of transistor Q2 having its collector connected to switch 104 and its emitter connected through diode D10 to drive the down trim at the low speed and having a diode D9 connected to ground. Twelve volt power is received by the battery through diode D11 which is connected to the switch 104. Diode D11 is also connected through resistor R39 (27 ohm) to produce the positive power +V supplied within the assembly 10, and having zener diode D12 connected to ground with parallel capacitor C13 (0.1 uF) and capacitor C14 (47 uF).

The low speed reset means 46 includes a one-shot monostable multivibrator 105 (MC14538BCP) configured as a one-shot having input pin 4 connected to the second T2 and third T3 terminals of switch 102 and pin 5 which is inverted connected to the voltage supply, pin 3 is connected to the voltage supply, pin 1 is connected to ground and to capacitor C6 to pin 2 and pin 2 is connected to resistor R15 to power. Pin 6 has no connection, and pin 7 or the Q' output is connected to an input of NAND gate 106. The NAND gate 106 also has an input connected to the output of AND gate 118, and subsequently described. The output of NAND gate 106 provides the reset signal at pin 4 of the D flip flop 74. The high speed reset means 60 comprises a one shot monostable multivibrator 110 (MC14538DCP) having its input pin 12 connected to the first T1 and fourth T4 terminals of switch 102 and pin 11 connected to power which is inverted, pin 13 is connected to power, pin 15 is connected to ground and to capacitor C7 (1.0 uF) to pin 14, and pin 14 is connected through resistor R16 (1.8 K Ohms) to power. Pin 10 has no connection, and the output pin 9 or Q' is connected to the input of NAND gate 112 having a second input connected to AND gate 118. The output of NAND gate 112 is connected to the reset pin 10 of the flip flop 88.

The initiation means 62 includes a one-shot monostable multivibrator 114 (MC14538BCP) having pin 5 connected to power +V and pin 4 connected to power through a delay filter comprising R21 (5.1 K Ohms) and capacitor C9 (2.2 uF) connected to ground. Pin 1 is connected to ground and to capacitor C10 (1.0 uF) and to pin 2, and pin 2 is connected to resistor R22 (10 K Ohm) to voltage, pin 7 has no connection, pin 3 is connected to voltage, and pin 6 provides a Q output. Also included is D flip flop 116 having the D input pin 5 connected to power +V and the clock input pin 3 grounded, the set input pin 6 is connected to the Q output pin 6 of multivibrator 114. The Q' output 2 is connected to the two inputs of AND gate 118 whose output is connected to the output of NAND gates 106 and 112. Also included monostable multivibrator 128 (MC14538BCP) having its Q output connected to the reset input of D flip flop 116. Pin 13 is connected to positive voltage, and the Q' output has no connection. Pin 15 is connected to ground and to capacitor C11 (1 uF) and to pin 14, pin 14 is also connected to resistor R19 (2.7 K Ohm) to power, input pin 12 is connected through resistor R20 (1 K Ohm) to ground, and to diode D3 to ground, and to capacitor C8 (1 uF) to the output of operational amplifier 132, pin 11 is inverted and connected to the output of NAND gate 124 having its inputs connected to the output and input of operational amplifier 132 pins 8 and 9, respectively. The D flip flop 116 and the monostable 128 comprise the initiation reset logic.

The initiation means 62 also includes a transition detector for detecting whether the trim position is less than or greater than the first position.

The transition detector portion of the initiation means 62 includes the operational amplifier 132 having its noninverting input connected to resistors R17, R18 and its inverting input connected to the output of operational amplifier 92 when the switch 102 is in the high position, and operational amplifier 98 when the switch 102 is in the low position. One of the inputs of AND gate 120 also receives the switch output at terminals 2 and 3, with the second input received by the output Q or pin 1 of D flip flop 116, which is also received by AND gate 122 having its second input connected to the output of operational amplifier 132. The output of AND gate 120 is connected to the set input pin 8 and D flip flop 88, and the output of AND gate 122 is connected to the set input of D flip flop 74.

In operation of the switch 104, the switch is open while the position of the trim of the engine is set manually. With switch 104 still open, the first and second position potentiometers 32, 38 may then be adjusted to the point when their respective LED D8, D5 just turn on and off to indicate that the potentiometer 32, 48 are in their respective position to establish either the first or second position at the present set position of the engine 14. The power switch 104 is then closed to automatically trim the engine 14 based on the speed.

Also included is the method of automatically trimming the engine in a boat. The method includes the steps of sensing the speed of the boat, switching between a first condition when the speed is less than a predetermined speed and a second condition when the speed exceeds a second predetermined speed, trimming the engine to a first position in response to a first condition, and trimming the engine to a second position in response to a second condition.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An automatic trim assembly for adjusting the trim of an engine in a boat, said assembly comprising: control means (16) for automatically and cyclically trimming the engine (14) from a second position to a first position directly in response to a first condition and from said first position to said second position directly in response to a second condition; speed switch means (18) connected to said control means (16) for sensing the speed of the boat (12) and for automatically switching from said second condition to said first condition when the speed is less than a first predetermined speed and for automatically switching from said first condition to said second condition when the speed exceeds a second predetermined speed, said speed switch means (18) producing a speed signal indicative of one of the first and second condition; said control means (16) including first position means (32) for setting said first position of the trim and for producing a first position signal and low speed adjustment means (26) responsive to said speed switch means (18) and said actual position signal for trimming the engine (14) to said first position in response to said first condition; said low speed adjustment means (26) including enabling means (36) for receiving said speed signal and producing an enabling signal while receiving said first condition signal, low speed delay means (38) for receiving said enabling signal and producing a momentary delay signal after a predetermined time of continuously receiving said enabling signal, and low speed lock-out means (40) for receiving said delay signal and a low speed off signal to product a gate signal in the presence of only one of said enabling signal and a low speed off signal.

2. An assembly as set forth in claim 1 further characterized by said speed switch means (18) comprising a pressure switch connected to a pitot tube of the engine (14) and being normally closed in the first condition.

3. An assembly as set forth in claim 2 further characterized by said control means (16) including trim position means (24) for producing an actual position signal indicative of the absolute trim position of the engine (14).

4. An assembly as set forth in claim 3 further characterized by said control means (16) including second position means (48) for manually setting said second position of the trim to produce a first position signal.

5. An assembly as set forth in claim 4 further characterized by said control means (16) including first position comparator means (34) for receiving and comparing said actual position signal and said first position signal to produce a low speed actuate signal.

6. An assembly as set forth in claim 5 further characterized by said control means (16) including second position comparator means (50) for receiving and comparing said actual position signal to said second position signal to produce an high speed actuate signal.

7. An assembly as set forth in claim 6 further characterized by including filter means (30) connected to said speed switch means (18) for eliminating noise from said speed signal to produce a filtered speed signal.

8. An assembly as set forth in claim 7 further characterized by said control means (16) including high speed adjustment means (28) responsive to said speed switch means (18) and said actual position signal for trimming the engine (14) to said second position in response to said second condition.

9. An assembly as set forth in claim 8 further characterized by said low speed adjustment means (26) including low speed device means (42) for receiving said gate signal and producing a drive signal to trim the engine (14) toward said first position, and for producing said low speed off signal in the absence of said gate signal and receiving a reset signal.

10. An assembly as set forth in claim 9 further characterized by said high speed adjustment means (28) including enabling means (52) for receiving said filtered speed signal and for producing an enabling signal while receiving said second condition and said low speed off signal.

11. An assembly as set forth in claim 10 further characterized by said high speed adjustment means (28) including high speed delay means (54) for receiving said enabling signal and producing a momentary delay signal after a predetermined time of continuously receiving said enabling signal.

12. An assembly as set forth in claim 11 further characterized by said high speed adjustment means (28) including high speed lock-out means (56) for receiving said delay signal and a high speed off signal to produce a gate signal in the presence of only one of said enabling signal and said low speed of signal.

13. An assembly as set forth in claim 12 further characterized by said high speed adjustment means (28) including high speed drive means (58) for receiving said gate signal and producing a drive signal to trim the engine (14) toward said second position, and producing said high speed off signal in the absence of said gate signal and receiving a reset signal.

14. An assembly as set forth in claim 13 further characterized by including low speed reset means (46) for receiving said low speed actuate signal and producing said low speed reset signal.

15. An assembly as set forth in claim 14 further characterized by including high speed reset means (60) for receiving said high speed actuate signal and producing said high speed reset signal.

16. An assembly as set forth in claim 15 further characterized by including power switch means (104) for manually closing to power said assembly for automatic trim control.

17. An assembly as set forth in claim 16 further characterized by including initiating means (62) for trimming the engine to said first position upon closing of said power switch means (104).

18. An assembly as set forth in claim 17 further characterized by including inhibit means (64) for inhibiting said initiating means (62) from trimming the engine (14) to said first position when said speed switch (18) is in said second position.

19. An assembly as set forth in claim 1 further characterized by said speed switch means (18) comprising a paddle wheel sender (23) for sensing speed and producing a square wave signal, converter (25) for receiving said square wave signal and producing an output signal, and comparator (27) for receiving said output signal and producing said speed signal.

20. An assembly as set forth in claim 1 further characterized by said control means including delay means (38) for delaying the trimming of the engine (14) from said second position to said first position for a predetermined time in response to said speed switch means (18) remaining in said first condition for said predetermined time.

21. An automatic trim assembly for adjusting the trim of an engine based on the speed of the boat, said assembly comprising: high low position means responsive to manual actuation for setting a first position producing a first position signal; high position means responsive to manual actuation for setting a second position; actual position means for monitoring the actual position of the engine and for producing an actual position signal; control means (16) for receiving the boat speed and the actual position signal to automatically and cyclically control the position of the engine (14) to said first position when the speed is less than the first predetermined speed and to said second position when the speed si greater than a second predetermined speed; said control means (16) including first position comparator means (34) for receiving and comparing said actual position signal and said first position signal to produce a low speed actuate signal, reset means (46) for receiving said low speed actuate signal and for producing a reset signal based thereon, low speed adjustment means (26) for receiving the speed of the boat to trim the engine (14) to said first position in the presence of said low speed actuate signal and in the absence of said reset signal and for preventing trimming to said first position in the absence of said low speed actuate signal and in the presence of said reset signal.

22. An automatic trim assembly for adjusting the trim of an engine based on the speed of the boat, said assembly comprising: actual position means (24) for monitoring the actual position of the engine speed means (18) for producing a speed signal indicative of the sped of the boat; control means (16) for receiving the actual position of the engine (14) and automatically and cyclically trimming the engine (14) from a second position to a first position when said speed signal is less than a first predetermined speed and from said first position to said second position when said sped signal is above a second predetermined speed in response to said speed means (18); said control means (16) including low speed adjustment means (26) responsive to said speed means (18) and said actual position means (24) for trimming the engine (14) to said first position, and high speed adjustment means (28) responsive to said speed means (18) and said actual position means (24) for trimming the engine (14) to said second position; said low speed adjustment means (26) including low enabling means (36) for receiving said speed signal and for producing a low enabling signal while receiving said first condition signal, low speed delay means (38) for receiving said low enabling signal and producing a momentary delay signal after a predetermined time of continuously receiving said enabling signal; said high speed adjustment means (28) including high enabling means (52) for receiving said filtered speed signal and for producing a high enabling signal while receiving said second condition signal, high speed delay means (54) for receiving said high enabling signal and producing a momentary delay signal after a predetermined time of continuously receiving said high enabling signal.

23. A method for automatically trimming an engine in a boat based on speed, the method including the steps of; sensing the speed of the boat, automatically cycling between a first condition and a second condition when the speed is less than a first predetermined speed and the speed exceeds a second predetermined speed, respectively; automatically trimming the engine from a second preset position to a first preset position in response to the first condition; automatically trimming the engine from the first preset position to the second position in response to the second condition; producing an enabling signal when in the first condition and receiving a high speed off signal; and producing a gate signal in the presence of only one of the enabling signal and a low speed off signal.

24. A method as set forth in claim 23 further characterized by including producing an actual position signal indicative of the absolute position of the engine.

25. A method as set forth in claim 24 further characterized by including manually setting the first position of the trim producing a first position signal and manually setting the second position of the trim producing a second position signal.

26. A method as set forth in claim 25 further characterized by comparing the actual position signal and first position signal to produce a low speed actuate signal.

27. A method as set forth in claim 26 further characterized by comparing the actual position signal to the second position signal to produce a high actuate signal.

28. A method as set forth in claim 27 further characterized by producing a memory delay signal after a predetermined time of continuously receiving the enabling signal.

29. A method as set forth in claim 28 further characterized by trimming the engine toward the first position in response to the gate signal, and producing the low speed off signal in the absence of the gate signal and receiving a reset signal.

30. A method as set forth in claim 29 further characterized by trimming the engine to the first position upon closing to power the assembly.

31. A method as set forth in claim 30 further characterized by inhibiting the trimming of the engine (12) to the first position when in the second position.

32. A method as set forth in claim 23 further including delaying the trimming of the engine (14) from said second position to said first position for a predetermined time in response to said speed switch means (18) remaining in said first condition for said predetermined time.

33. An automatic trim assembly for adjusting the trim of an engine in a boat, said assembly comprising: manual actuation means (104) for supplying and discontinuing power; control means (16) responsive to said manual actuation means (104) for receiving power and for automatically and cycling trimming the engine (14) from a second position to a first position directly in response to a first condition and from said first position to said second position directly in response to a second condition; speed switch means (18) connected to said control means (16) for sensing the speed of the boat (12) and for automatically switching from said second condition to said first condition when the speed is less than a first predetermined speed and for automatically switching from said first condition to said second condition when the speed exceeds a second predetermined speed; said control means including initiating means (62) for producing an initiating signal and initially trimming the engine to said first position upon initial closure of said manual actuation means (104), and inhibit means (64) for inhibiting said initiating means (62) from trimming the engine (14) after the initial trimming of the engine until a subsequent interruption of power by said manual actuation means (104) and allowing said control means (16) to automatically trim the engine (14) between said first and second positions while said initiating means (62) is inhibited.

34. An assembly as set forth in claim 33 wherein said initiating means includes a power-up one shot for producing a pulse only upon initiation of power to said assembly to control said initiating means:

35. An assembly as set forth in claim 33 wherein said control means includes first position means (32) for setting said first position of the trim and for producing a first position signal, and low speed adjustment means (26) responsive to said speed switch means (18) and said actual position signal and said initiating means for trimming the engine (14) to said first position wherein said low speed adjustment means (26) is responsive to said initiating means (62) upon power to said assembly and thereafter responsive only to said speed switch means and said actual position signal until power interruption.

36. An assembly as set forth in claim 33 wherein said inhibit means includes means for preventing said initiation means from trimming the engine when said manual actuation means (104) initiates the supply of power and the speed is greater than said first predetermined speed.

* * * * *